US005283988A

United States Patent [19]

Brown

[11] Patent Number: 5,283,988

[45] Date of Patent: Feb. 8, 1994

[54] MANUAL VACUUM SANDER

[76] Inventor: Geoffrey P. Brown, 1923 West 41st Avenue, Vancouver, British Columbia, Canada

[21] Appl. No.: 925,905

[22] Filed: Aug. 5, 1992

Related U.S. Application Data

[63] Continuation of Ser. No. 674,536, Mar. 22, 1991, abandoned, which is a continuation-in-part of Ser. No. 448,871, Dec. 12, 1989, abandoned.

[51] Int. Cl.[5] ..... B24D 15/04

[52] U.S. Cl. ..... 51/392; 51/180; 51/273; 51/170 R

[58] Field of Search ..... 51/170 R, 170 TL, 170 MT, 51/180, 273, 358, 362, 391-393; 15/415.1, 421

[56] References Cited

U.S. PATENT DOCUMENTS

| | | | |
|---|---|---|---|
| 2,048,273 | 7/1936 | Ljungquist | 15/421 |
| 2,283,428 | 5/1942 | Ellis | 15/421 X |
| 3,039,463 | 6/1962 | Dickey, Jr. et al. | 15/421 |
| 3,071,799 | 1/1963 | Jepson et al. | 15/421 |
| 3,332,101 | 7/1967 | Leinfelt et al. | 15/421 |
| 3,517,669 | 6/1970 | Buono et al. | 15/421 |
| 3,527,111 | 9/1970 | Zimmerman | 51/170 R X |
| 3,754,354 | 3/1973 | Franlinna | 51/273 X |
| 3,785,092 | 1/1974 | Hutchins | 51/273 |
| 3,834,388 | 9/1974 | Sauer | 15/421 X |
| 4,062,152 | 12/1977 | Mehrer . | |
| 4,184,291 | 1/1980 | Marton | 15/421 X |
| 4,202,140 | 5/1980 | Alessio | 51/273 |
| 4,616,449 | 10/1986 | Marton . | |
| 4,680,895 | 7/1987 | Roestenberg . | |
| 4,759,155 | 7/1988 | Shaw | 51/392 |
| 4,779,385 | 10/1988 | Reiter | 51/273 X |
| 4,937,984 | 7/1990 | Taranto | 51/180 X |
| 5,007,206 | 4/1991 | Paterson | 51/273 X |
| 5,036,627 | 8/1991 | Walters | 51/180 |

*Primary Examiner*—Robert A. Rose
*Assistant Examiner*—Bryan Reichenbach
*Attorney, Agent, or Firm*—Barrigar & Oyen

[57] ABSTRACT

Current manual vacuum sanders do not adequately capture dust from around the edges of the sander. The present invention provides a back-up pad for a vacuum hand sanding device for sanding a working surface, where the device is of the type comprising a tailpiece for connecting a source of vacuum, a base for attaching a back-up pad and screw clamps for releasably attaching an abrasive, air-permeable sheet. The back-up pad comprises an inner recessed lower surface, apertures formed in the inner recessed lower surface for communicating with the vacuum source, a raised perimeter having an outer edge and extending downwardly from the inner recessed lower surface thereby forming a chamber communicating with said apertures between a working surface and the inner recessed lower surface when the sander is placed on the working surface, wherein the raised perimeter is provided with a plurality of grooves extending from the outer edge to the inner chamber, and a plurality of support surfaces extending downwardly from the inner surface a distance equal to the height of the raised perimeter. The tailpiece provides for adjustment of the vacuum pressure to the working surface by varying the size of an opening to the sander handle interior.

3 Claims, 5 Drawing Sheets

MANUAL VACUUM SANDER

CROSS-REFERENCE TO RELATED APPLICATIONS

This is a continuation of application Ser. No. 674,536 filed Mar. 22, 1991, now abandoned, which is a continuation-in-part of application Ser. No. 448,871 filed Dec. 12, 1989, now abandoned.

BACKGROUND OF THE INVENTION

The invention relates to tools for manual sanding and more particularly to sanding devices provided with a vacuum connection for drawing off the dust created by the sanding action.

The sanding of wood or plaster is typically accomplished using a sanding block which is hand-held and to which sheets of sand paper can be removably attached. The dust generated by the sanding action falls freely in the work area and therefore requires subsequent cleanup.

Various devices have been designed to provide a vacuum connection to the sander head to pick up the dust generated by the sanding action in the vicinity of the sander head. For example, U.S. Pat. No. 4,062,152, issued Dec. 13, 1977 to Mehrer discloses a sander which is connected to a vacuum source by a hollow tubular handle. A porous abrasive sheet is mounted on the front surface of a backing plate which has a number of bores which provide an air passageway from the abrasive sheet to a manifold which in turn communicates with the tubular handle by a hollow sleeve universally mounted on the sander body. This device is suited for use on the end of a long handle, but not for holding in the user's hand. Further, the design of the backing plate is not conducive to picking up dust around the edges of the sander, and the vacuum is lost when one end of the device is lifted.

Another vacuum sanding device is disclosed in U.S. Pat. No. 4,184,291, issued Jan. 22, 1980 to Marton. Marton discloses a sander with a circular backup pad having a number of apertures. The sanding disc has matching apertures. A relief valve is provided to allow the worker to release the suction from the sanding pad. However again the arrangement of apertures in the backing pad is such that dust generated near the edges of the pad is not picked up. The shape of this sander is also not well adapted for reaching corners, as is necessary in most home renovation situations.

U.S. Pat. No. 4,680,895 issued Jul. 21, 1987 to Roestenberg discloses a rectangular hand-held vacuum sanding block in which the vacuum suction is provided along either vertical edge of the device, with skirts being provided to direct the suction along either edge. This design is not effective to sand into a corner, and the suction does not assist in holding the sander to the wall.

Finally, in a more recent Marton U.S. Pat. No. 4,616,449 issued Oct. 14, 1986, the problem of gathering dust around the periphery of the sanding device is addressed. Again, the proposed solution is the provision of a peripheral opening formed between a chamfered edge of the base and a peripheral rim. Such an arrangement is still not completely effective to pick up dust around the edges of the sanding surface.

Other prior art sanding devices are shown in Shaw U.S. Pat. No. 4,759,155 and Reiter U.S. Pat. No. 4,779,385. Such devices provide a vacuum chamber behind the support pad which adds to the cost of manufacture and reduces the effectiveness of the vacuum suction around the periphery of the pad.

SUMMARY OF THE INVENTION

The present invention provides a back-up pad for a vacuum hand sanding device for sanding a working surface, where the device is of the type comprising means for connecting a source of vacuum, a base for attaching a back-up pad and means for releasably attaching an abrasive, air-permeable sheet. The back-up pad comprises an inner recessed lower surface, an aperture formed in the inner recessed lower surface for communicating with the vacuum source, a raised perimeter having an outer edge and extending downwardly from the inner recessed lower surface thereby forming a chamber communicating with said aperture between a working surface and the inner recessed lower surface when the sander is placed on the working surface, wherein the raised perimeter is provided with a plurality of grooves extending from the outer edge to the inner chamber, and a plurality of support surfaces extending downwardly from the inner surface a distance equal to the height of the raised perimeter.

BRIEF DESCRIPTION OF THE DRAWINGS

In drawings which illustrate a preferred embodiment of the invention.

DETAILED DESCRIPTION OF A PREFERRED EMBODIMENT

Figure 1:
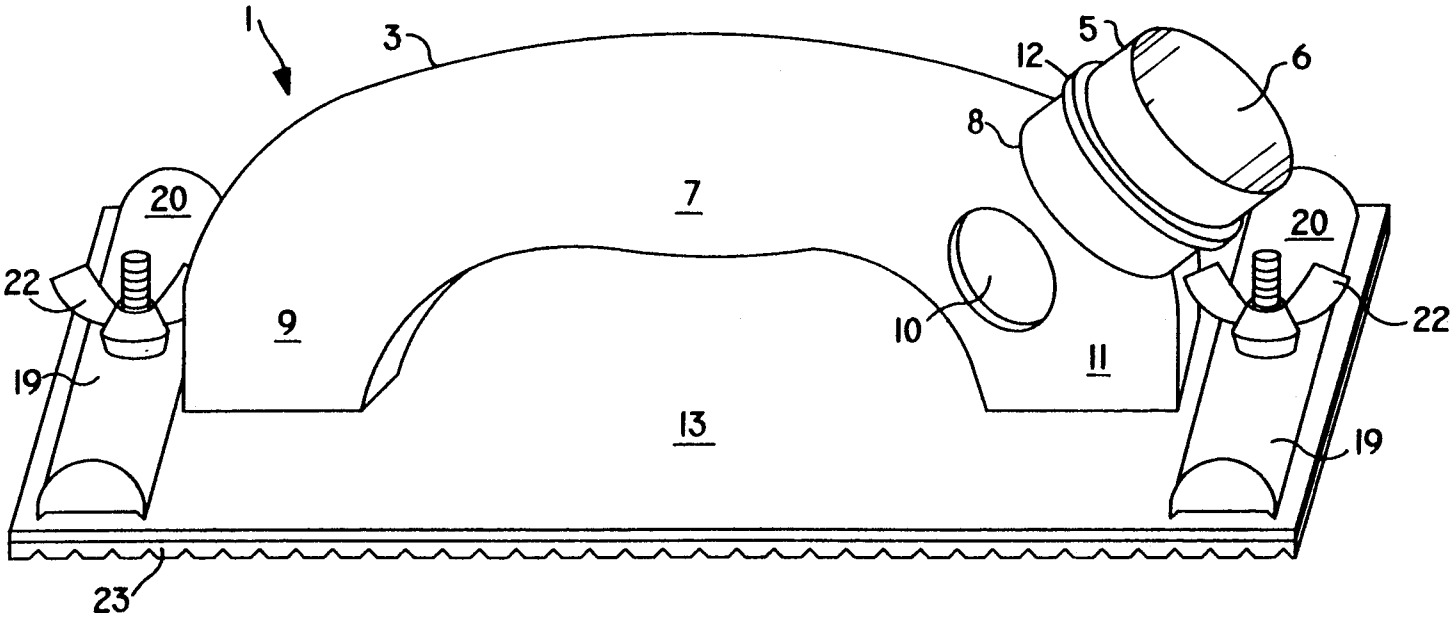
FIG. 1 is a perspective view of the invention.
Figure 2:
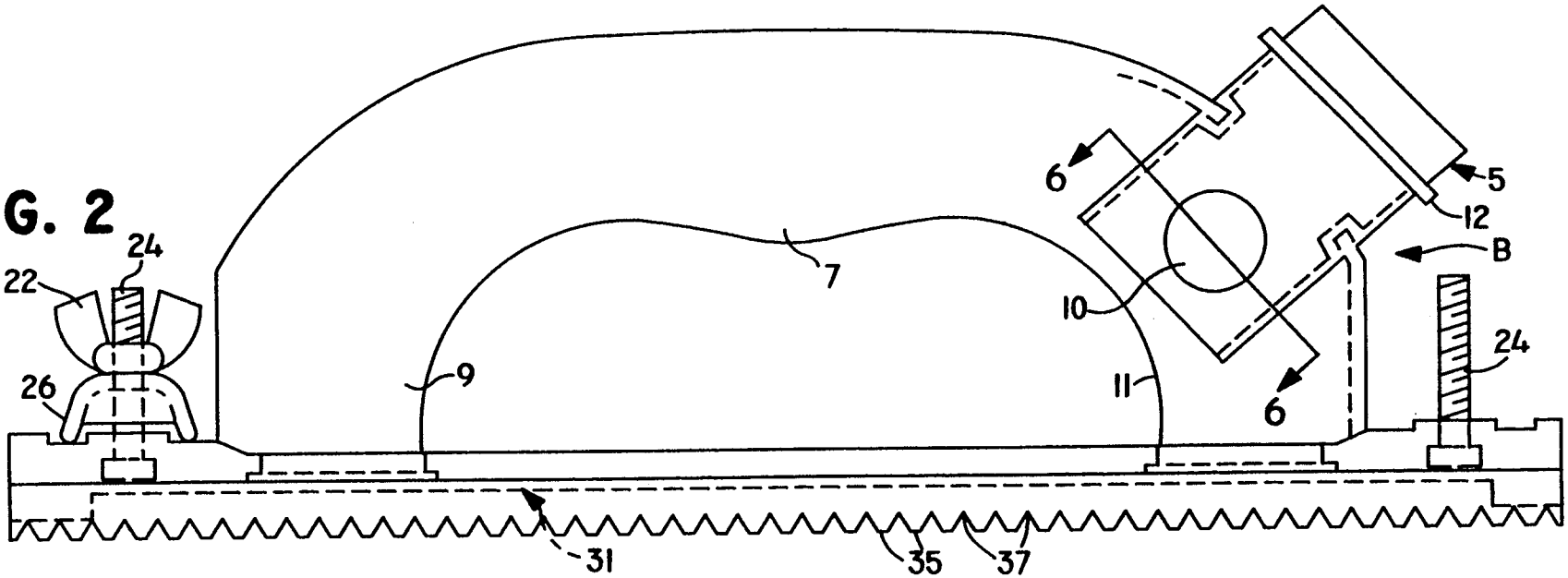
FIG. 2 is a side view of the invention shown in FIG. 1.

The vacuum sander of the invention is designated generally by reference numeral 1. It comprises a hollow handle 3 of moulded plastic which has a hollow, round tail-piece 5 with opening 6 for connection to a standard shop vacuum hose, a hollow horizontal hand-receiving portion 7 and two downwardly extending hollow arms 9 and 11. The lower ends of arms 9 and 11 are fixed to a solid base member 13 which is provided with two holes 15 and 17 which communicate with the interior of handle 3 via arms 9 and 11. Handle 3 is provided with circular apertures 10 on either side of tail-piece 5.

Figure 3:
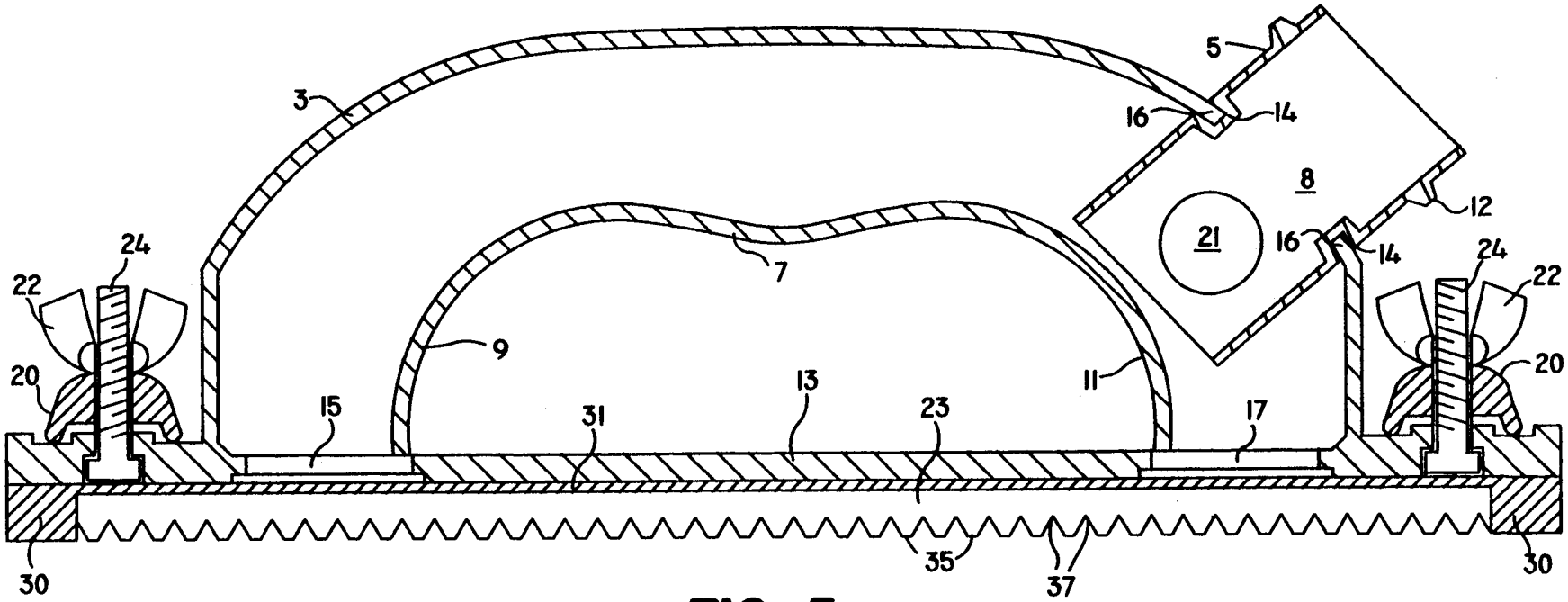
FIG. 3 is a cross-sectional view taken along lines 3—3 of FIGS. 4 and 5.
Figure 6:
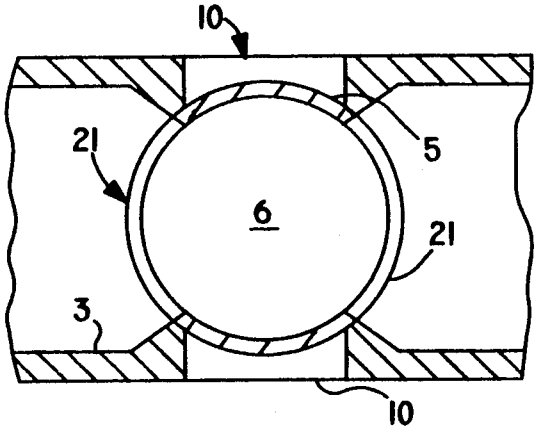
FIG. 6 is a sectional view taken along lines 6—6 of FIG. 2.

As shown in FIGS. 3 and 6, tail-piece 5 is a hollow, cylindrical pipe having two circular apertures 21. Exterior, annular ridge 12 permits the vacuum hose to be attached. Tailpiece 5 also has an annular groove 14. The circular edge 16 of circular hole 8 in handle 3 sits in groove 14, providing a snug fit so that tail-piece 5 can be rotated but enough friction exists to retain tail-piece 5 in a set rotational position until an appropriate rotational force is applied. The handle 3 can be molded as two pieces to snap around tail-piece 5 in assembly.

As shown in FIG. 6, the inner surface of handle 3 forms a circular ridge around holes 10 which slides against the surface of tail-piece 5. In this way the flow of air between passage 6 and holes 10 can be regulated by rotation of tailpiece 5. When a source of vacuum is attached to tail-piece 5, and tail-piece 5 is rotated to the orientation shown in FIG. 6, the maximum vacuum will be created in the interior of handle 3. Rotation of tail-piece 5 then permits air to flow into the interior of tail-piece 5 through holes 10. This permits the user to regulate the degree of vacuum applied to the base of the sander.

Base 13 is provided at either end thereof with a screw clamp 19, consisting of clamping bar 20, wing nuts 22 and bolts 24 which are of standard construction, for releasably securing a sheet of abrasive, air-permeable mesh (not shown) of the type sold by the 3M Company for use as a gyproc filler mesh sanding pad. Fixed to the bottom of base 13 is a moulded neoprene rubber backing pad 23, also provided with two holes 25 and 27 which are co-extensive with holes 15 and 17 in base 13. Pad 23 has a series of raised support ridges 29 and raised perimeter 30 which extend upwardly from the inner recessed surface 31 of pad 23. By way of example, the rubber backing pad 23 may be approximately 0.045 to 1/16-inch thick in the vicinity of surface 31, and ½-inch thick in the vicinity of ridges 29 and perimeter 30. Raised perimeter 30 extends completely around the perimeter of base 13 with a width of approximately ⅜-inches. Passageways 40 which are approximately ⅛-inch wide separate the various ridges 29.

Perimeter 30 is provided with regularly spaced ridges 35 and grooves 37 forming a rippled surface. Grooves 37 are approximately ⅛-inch deep and ridges 35 are approximately 1/16-inch wide. Grooves 37 provide an air passageway from the exterior edge of sander 1 to the negative pressure storage chamber formed between the surface being sanded and surface 31 which in turn communicates with holes 25 and 27. In the corners a further diagonal groove 39 is required to provide communication to the grooves 37 in that area.

Figure 4:
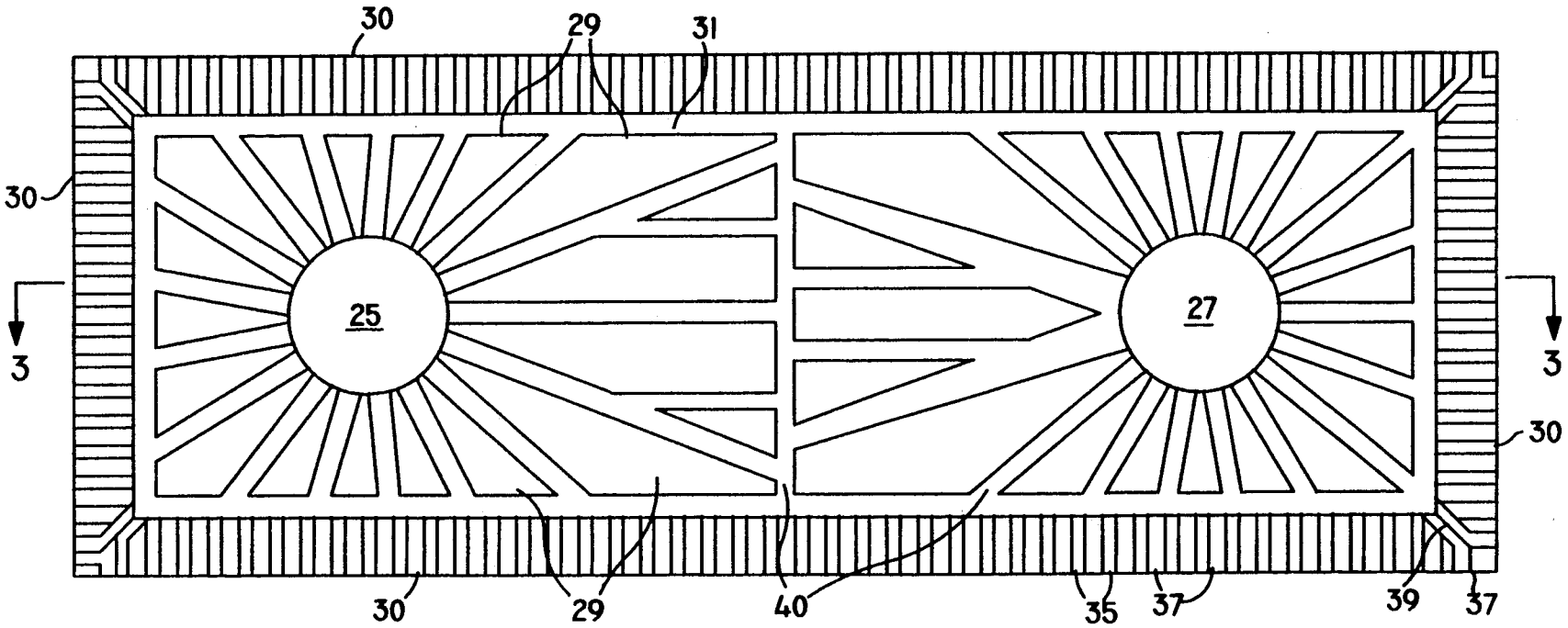
FIG. 4 is a bottom view of the invention shown in FIG. 1.
Figure 5:
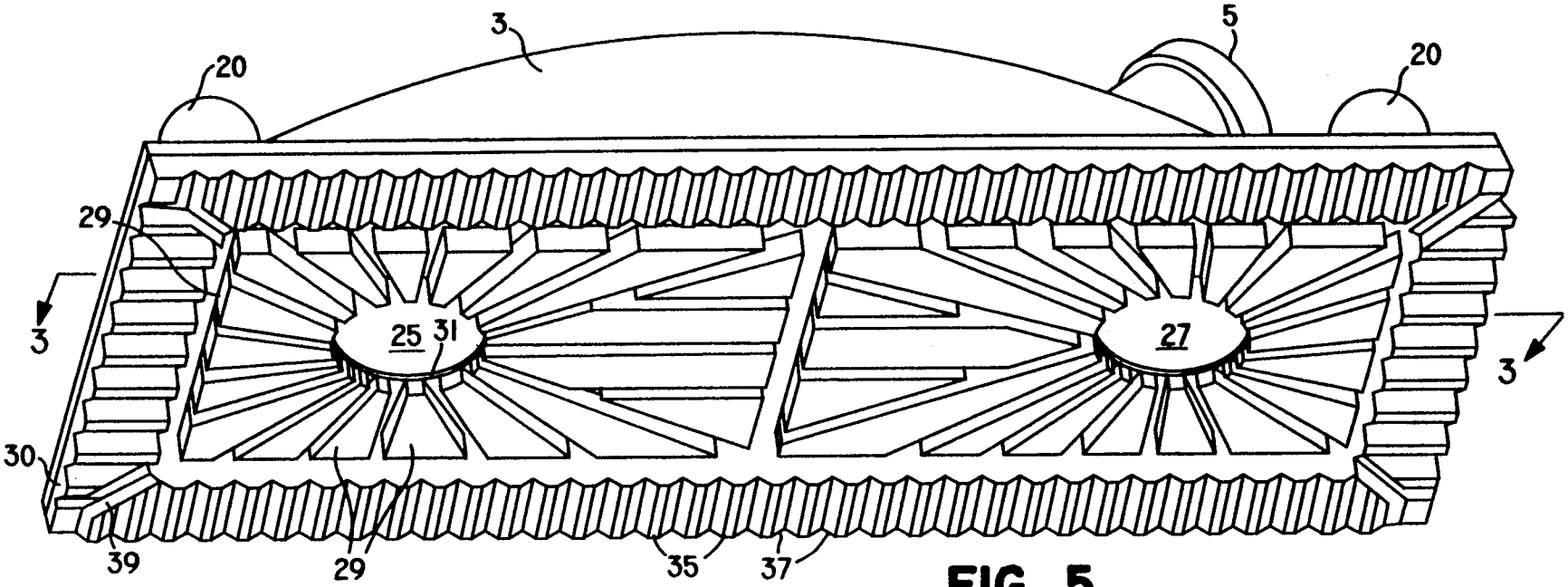
FIG. 5 is a perspective view of the invention from below.
Figure 7:
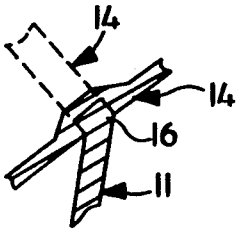
FIG. 7 is a detail view of area B in FIG. 2.

The geometric arrangement of ridges 29 may be varied so long as sufficient support is provided to the abrasive sheet 21 and sufficient air flow is permitted between perimeter 30 and holes 25 and 27. As shown in FIG. 4, the patterns may be varied in a complementary fashion as between the right hand side adjacent hole 25 in FIG. 4 and the left hand side adjacent hole 27 so that the abrasive sheet can be reversed as it becomes worn and fresh surfaces will be exposed to the underlying support after such reversal. The depth and width of grooves 37 is chosen to provide sufficient suction when a standard shop vacuum is used to hold the tool lightly to the wall or other surface without restricting the sanding motion. Prefereably the total cross-sectional area of grooves 37 is about equal to the area of passage 6.

As in existing sanding blocks, the rubber material chosen for rubber backing pad 23 is sufficiently resilient to conform to small lumps or protrusions on the working surface while being sufficiently durable for a long life. The rubber backing pad is molded as a sin as is base 13.

Due to the fact that the negative pressure storage chamber for the low pressure area in the present invention is formed between the working surface and the backing pad, there is a more efficient transfer of air from around the perimeter of the pad to the vacuum discharge. Further, the provision of rotatable tail-piece 5 permits the amount of suction applied to the wall to be varied in the event that the pad is sticking to the wall due to overly great suction, for example.

As will be apparent to those skilled in the art, various modifications and adaptations of the structure above described may be made without departing from the spirit of the invention, the scope of which is to be construed in accordance with the accompanying claims.

I claim:

1. A sanding device for attachment to a source of vacuum and sanding a working surface comprising:

a) a thin, planar base member having upper and lower planar surfaces and first and second apertures extending through the thickness dimension thereof at spaced locations from the upper to the lower surface;

b) a hollow handle secured to said upper surface of said base member, said handle having an opening for connecting a source of vacuum, the interior of said handle being in fluid communication with both said first and second apertures in said base member and with said opening;

c) an elastomeric supporting pad having first and second apertures formed through the thickness dimension thereof at spaced locations in registry with the locations of said apertures in said base member, said supporting pad comprising an upper planar surface and a lower planar surface, said upper planar surface of the supporting pad being secured directly to said lower surface of said base member, said lower planar surface of the supporting pad comprising a plurality of channels forming a raised outer perimeter having an inner edge and an outer edge and a plurality of air distribution passageways communicating between said apertures of the supporting pad and said inner edge of said outer perimeter, said channels and said air distribution passageways thereby forming with said working surface a sole negative pressure storage chamber of the device located between the hollow handle and the raised outer perimeter, said outer perimeter having a lower surface which comprises a plurality of passageways provided across said perimeter to communicate between said inner and outer edge, and d) means for releasably attaching an abrasive, air-premeable sheet to overlay said supporting pad.

2. The device of claim 1 wherein said hollow handle is provided with a first aperture communicating between the interior of said handle and the exterior of said device and means for variably allowing air from the exterior of said device to enter into the interior of said hollow handle.

3. The device of claim 2 wherein said means for variably allowing air to enter the handle comprises a second aperture in fluid communication with said opening for connecting a source of vacuum, whereby said second aperture is rotatable into and out of alignment with said first aperture.

* * * * *